US005653216A

United States Patent [19]

Johnson

[11] Patent Number: 5,653,216

[45] Date of Patent: Aug. 5, 1997

[54] TOY ROCKET LAUNCHER

[75] Inventor: Lonnie G. Johnson, Smyrna, Ga.

[73] Assignee: Johnson Research & Development Co, Inc., Smyrna, Ga.

[21] Appl. No.: 406,629

[22] Filed: Mar. 20, 1995

Related U.S. Application Data

[60] Continuation-in-part of Ser. No. 397,474, Mar. 2, 1995, Pat. No. 5,538,453, which is a division of Ser. No. 165,647, Dec. 8, 1993, Pat. No. 5,407,375.

[51] Int. Cl.[6] ..... F41B 11/26; F41B 11/32

[52] U.S. Cl. ..... 124/69; 124/70; 124/75

[58] Field of Search ..... 124/56, 63, 69, 124/70, 71, 75

[56] References Cited

U.S. PATENT DOCUMENTS

| | | | |
|---|---|---|---|
| 2,733,699 | 2/1956 | Krinsky | 124/13 |
| 2,927,398 | 3/1960 | Kaye et al. . | |
| 3,003,490 | 10/1961 | Deterding et al. | 124/71 |
| 3,025,633 | 3/1962 | Kaye et al. . | |
| 3,049,832 | 8/1962 | Joffe . | |
| 3,121,292 | 2/1964 | Butler et al. . | |
| 3,739,764 | 6/1973 | Allport | 124/70 |
| 3,962,818 | 6/1976 | Pippin, Jr. . | |
| 4,159,705 | 7/1979 | Jacoby | 124/63 |
| 4,223,472 | 9/1980 | Fekete et al. . | |
| 4,411,249 | 10/1983 | Fogarty et al. | 124/64 |
| 4,774,928 | 10/1988 | Kholin | 124/75 |
| 4,897,065 | 1/1990 | Fertig et al. | 446/63 |
| 5,188,557 | 2/1993 | Brown | 446/212 |
| 5,337,726 | 8/1994 | Wood | 124/75 X |
| 5,373,832 | 12/1994 | D'Andrade | 124/69 |
| 5,381,778 | 1/1995 | D'Andrade et al. | 124/69 |

FOREIGN PATENT DOCUMENTS

2587911-A1 4/1987 France .

*Primary Examiner*—John A. Ricci

*Attorney, Agent, or Firm*—Kennedy, Davis & Kennedy

[57] ABSTRACT

A toy rocket launcher (100) is disclosed for launching a rocket (125) having a fuselage (126) with an elongated tail bore (127) extending from a tail end thereof. The rocket launcher has a launch tube (108) adapted to hold and maintain a selected, elevated pressure level. The launch tube has an opening (109) therein and a valve for controlling the flow of pressurized air flowing from the launch tube through the opening. The launcher also includes a pump (103) for pressurizing the launch tube and a trigger (104) for controlling the launch tube valve.

12 Claims, 7 Drawing Sheets

TOY ROCKET LAUNCHER

REFERENCE TO RELATED APPLICATION

This is a continuation-in-part of application Ser. No. 08/397,474 filed Mar. 2 1995 now U.S. Pat. No. 5,538,453 which is a divisional of application Ser. No. 165,647 filed Dec. 8, 1993 now U.S Pat. No. 5,407,375.

TECHNICAL FIELD OF THE INVENTION

The present invention relates generally to toys and hobby items and more particular to toy and model rockets launchers.

BACKGROUND OF THE INVENTION

For decades, toy rockets have been popular playthings for children of all ages. Such rockets have been made available in all shapes and sizes and many models have been provided with their own propellant, such as pressurized water, pressurized air, or the like. The popularity of toy rockets has even extended to adolescent and adult hobbies in the form of model rockets propelled by solid fuel rocket engines. As a matter of fact, model rocket enthusiasts often spend countless hours constructing model rockets that are large and extremely realistic. Such model rockets typically require a substantial financial investment and can be extremely valuable items for their owners.

Most toy rockets that have been the playthings of children are designed to be launched by one of various means into the air for flight. Rarely, however, have toy rockets been provided with deployable parachutes. Thus, once launched, toy rockets simply follow a trajectory up and then back down to the ground where they impact the earth. Since toy rockets are sturdy and follow relatively low altitude trajectories, their impact with the ground rarely causes damage and they are simply retrieved and launched again.

One type of toy rocket that functions in this way is commonly known as the "Nerf®" rocket. Nerf rockets usually have an elongated cylindrical fuselage that is made of a foam rubber material and that has fins affixed to and extending outwardly from the tail of the rocket. In use, "Nerf" rockets, like many other toy rockets, are propelled from a launcher by means of compressed air, whereupon they follow natural trajectories up and back to the earth.

In contrast to toy rockets, model rockets that are propelled by solid fuel rocket engines commonly are provided with parachutes that are deployed during flight of the rocket to ease the rocket gently back to the earth when its engines are spent. A parachute is desirable for model rockets because these rockets typically are heavier and more fragile than toy rockets and are propelled to much higher altitudes. Accordingly, if these model rockets are allowed to fall naturally back to earth, they can easily be destroyed upon impact with the ground. This is a particularly acute problem with large expensive model rockets, which sometimes include parachutes for each stage as well as redundant parachutes for more expensive portions of the rocket.

In model rockets, the parachute usually is folded and stowed in the nose-cone section of the rocket during flight. For deployment of the parachute, the nose-cone typically is ejected by means of an explosive charge that is activated as the rocket's engines burn out. With the nose-cone thus ejected, the parachute can unfold and deploy for easing the rocket body back to earth.

While such methods of deploying parachutes from model rockets have been relatively successful in the past, they nevertheless have been plagued with numerous problems and shortcomings inherent in their respective designs. For example, the explosive charge that ejects the nose-cone and deploys the chute usually is triggered by the burning engine of the model rocket. Ideally, it is desirable that the explosive charge occur after the engine has burned out. However, such accurate timing has proved elusive such that chute deployment sometimes occurs while the main engine is still burning or occurs after the rocket has reached apogee and is falling back to earth. In addition, the explosive charges that deploy the chutes must be replaced after each flight, which is tedious and time consuming and can become expensive after numerous flights. Also, it is not uncommon that the explosive charge designed to deploy the parachute fails to fire, whereupon a potentially expensive model rocket plummets back to earth and is destroyed.

As mentioned above, unlike model rockets, most toy rockets are not provided with parachutes. This is because toy rockets usually are inexpensive and rugged enough to withstand and impact with the earth. Further, there has previously been no convenient method of deploying a parachute from a toy rocket since there is no burning engine that can be used to trigger a chute deployment charge. Nevertheless, parachutes have been found to be amusing to children who play with toy rockets. It is thus desirable that toy rockets do deploy parachutes at the apogees of their trajectories to ease them back to earth and, in the process, to amuse their owners.

In the past, a few toy rockets have been provided with makeshift parachutes, but the chutes usually are simply wrapped around the body of the rocket and the rocket thrown or propelled into the air. With these types of toy rockets, the chute simply unwinds as the rocket tumbles upwardly through the air and, when fully unwound, deploys to stop the upward movement of the rocket and ease it back to earth. Obviously, such a method of stowing and deploying a parachute is highly undesirable since the rocket tends to tumble as it moves upwardly and does not fly straight through the air. Further, the time at which the chute deploys is completely uncontrollable and the chute rarely deploys at the apogee of the rocket's trajectory, where deployment is most desirable.

Turning next to rocket launchers, over the years rockets have been launched in a variety of manners. As previously described, most model rockets use solid fuel rocket engines to propel them into the air. These engines however can be quite dangerous since they expel extremely hot exhaust which may burn both the operator and surrounding property.

Rockets have also been designed to be launched by pressurized water or air. These types of rockets typically have a pressure tank in which the pressurized water or air is stored. The result of the impact of the rocket with the earth however may cause the pressure tank to crack. Should the pressure tank become cracked the rocket is inoperable. Another problem associated with pressurized water propelled rockets is that they require a ready supply of water for repetitive use. As a ready supply of water may not be available the use of these types of rockets may be limited. Additionally, in cold weather and in certain locations it may not be desired to expel water. This is especially true with the rockets which expel water upon the individual operating the rocket as they ascend.

Toy launching devices which propel projectiles have also been designed which use compressed air to launch the projectile, as shown in U.S. Pat. No. 4,159,705. This device however utilizes an elastic balloon to store compressed air mounted adjacent a rear end of a launching barrel. The compressed air must pass through a conduit and an aperture in the barrel in order to enter the barrel. As such, the pressurization of air within the barrel is not efficient or rapid. Hence, the projectile is not thrusted a great distance. Furthermore, the projectile is propelled by the pressurization of the launch tube rearward of the projectile. However, as the projectile moves through the launch tube the volume within the launch tube rearward of the projectile rapidly increases. The increase in this volume causes the air pressure therein to decrease, once again creating an inherent inefficiency.

Accordingly, it is seen that a need remains for a rocket launcher which may propel a rocket into the air in a safe and efficient manner. It is to the provision of such therefore that the present invention is primarily directed.

SUMMARY OF THE INVENTION

In a preferred form of the invention a launcher for launching a rocket of the type having a longitudinal pressure reservoir extending from a tail end thereof comprises a launch tube configured to be inserted into the rocket pressure reservoir and adapted to contain a static, elevated pressure level. The launch tube has oppositely disposed ends, an opening adjacent one end thereof, and valve means for controlling the flow of air through the opening. The launcher also has means for pressurizing the launch tube to the selected static pressure level and trigger means for operating the valve of the launch tube.

DETAILED DESCRIPTION OF THE PREFERRED EMBODIMENT

Figure 1:
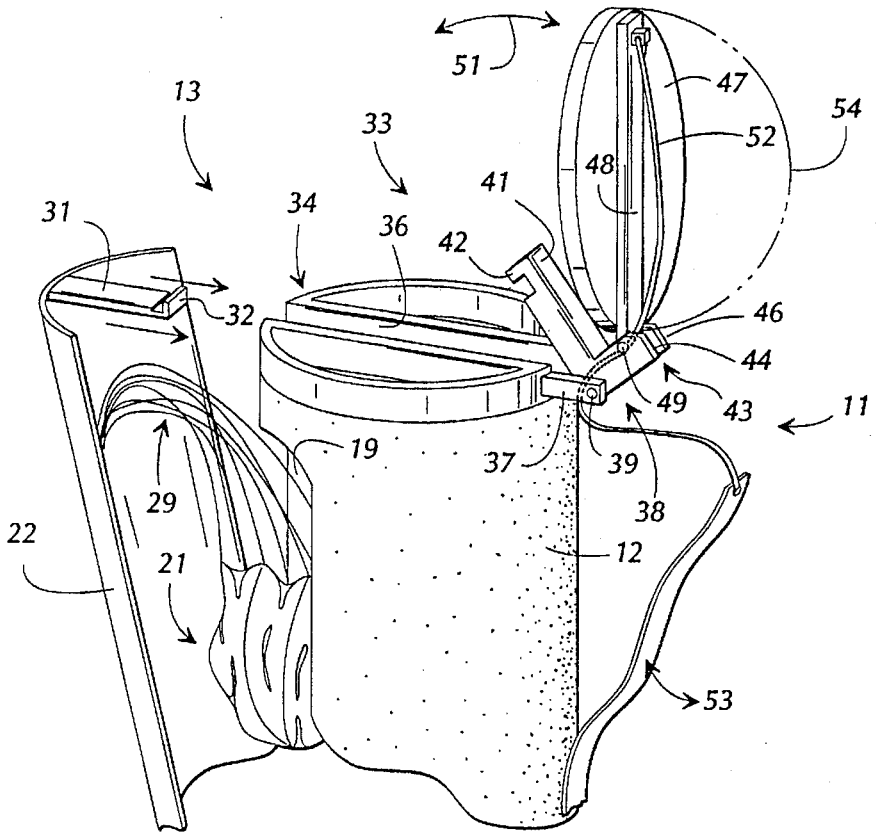
FIG. 1 is a perspective view of the nose-cone section of a toy rocket embodying principals of the present invention in a preferred form.

Referring now to the drawing, in which like numerals refer to like parts throughout the several views, FIG. 1 is a perspective view illustrating the nose-cone section of a toy rocket that embodies principals of this invention in a preferred from. The rocket 11 comprises a generally cylindrical elongated fuselage 12 having a nose section 13 at is top end and a tail section 14 (FIG. 5) at its bottom end. The tail section 14 is provided with a plurality of fins 15 for stabilizing the rocket during flight. Also, in the preferred embodiment, the tail end section 14 of the rocket is provided with a longitudinal bore extending from the tail of the fuselage. The bore is sized to receive the launch tube 17 of a launcher 18, which is designed to propel the rocket into the air by means of a burst of compressed air, as detailed below.

In the preferred embodiment, the fuselage 12 of the rocket 11 is formed from a foam material so that the rocket is relatively light and safe for children. A longitudinally extending cavity 19 is formed along one side of the fuselage 12. Preferably, the cavity 19 is formed integrally with the fuselage during the molding thereof, but could also be machined into the fuselage after molding. The cavity 19 is sized and configured to receive and contain a folded parachute 21 of conventional construction as best illustrated in FIG. 1.

Figure 2:
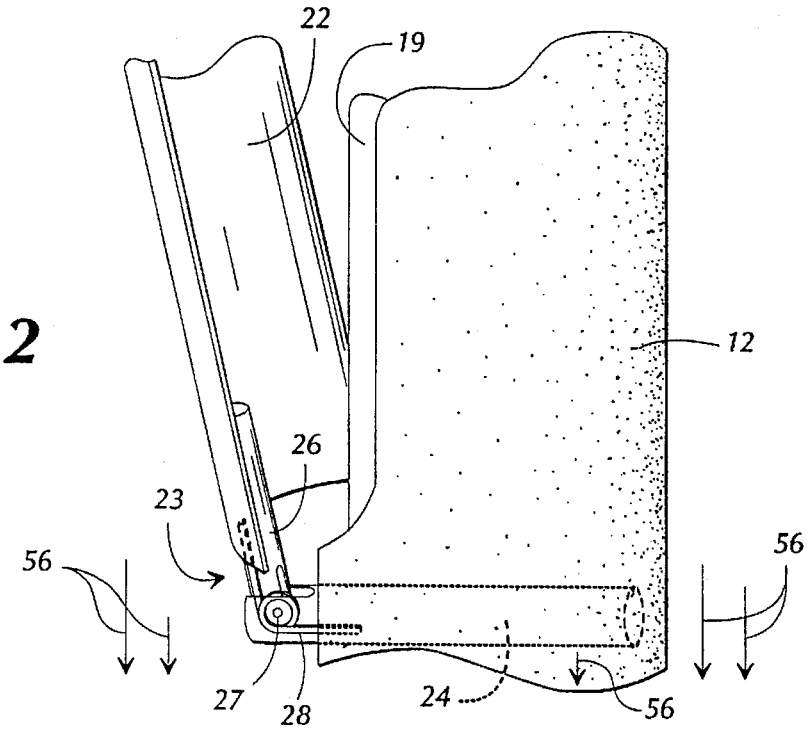
FIG. 2 is a perspective view of a portion of the fuselage of the rocket of FIG. 1 illustrating the hinged attachment of the hatch to the rocket fuselage for opening and closing the cavity.

An elongated curved hatch 22 has a lateral curvature corresponding to the curvature of the rocket fuselage 12 As illustrated in FIG. 2, the hatch 22 is affixed to the fuselage 12 just beneath the lower extent of cavity 19 by means of a spring biased hinge mechanism 23. The hinge mechanism 23 includes a first portion 24 that is embedded within the fuselage 12 and protrudes outwardly therefrom beneath the cavity 19. A second portion 26 of the hinge mechanism is fixed to the hatch 22 and is hingedly coupled to the first portion 24 by means of a hinge pin 27. A small coil spring 28 is disposed about the hinged pin and is arranged to bear with tension against the second portion 26 of the hinge mechanism to spring bias the hatch 22 toward its open position as best illustrated in FIG. 2.

With the just described hatch configuration, it can be seen that the hatch 22 is movable at its hinged attachment between a first position covering and closing the cavity 19 for confining the folded parachute to the cavity and a second position displaced from and opening up the cavity 19 for deployment of the parachute. A plurality of parachute cords 29 (FIG. 1) are each attached at one end to the periphery of the chute and the cords are all fixed at their other end to the interior portion of the hatch 22 near its upper extent. In this way, when the hatch moves from its closed position to its open position, the moving hatch pulls the parachute cords 29 and thus the chute 21 out of the cavity 19 thus ejecting the parachute from the cavity for quick and reliable deployment of the chute.

Figure 3:
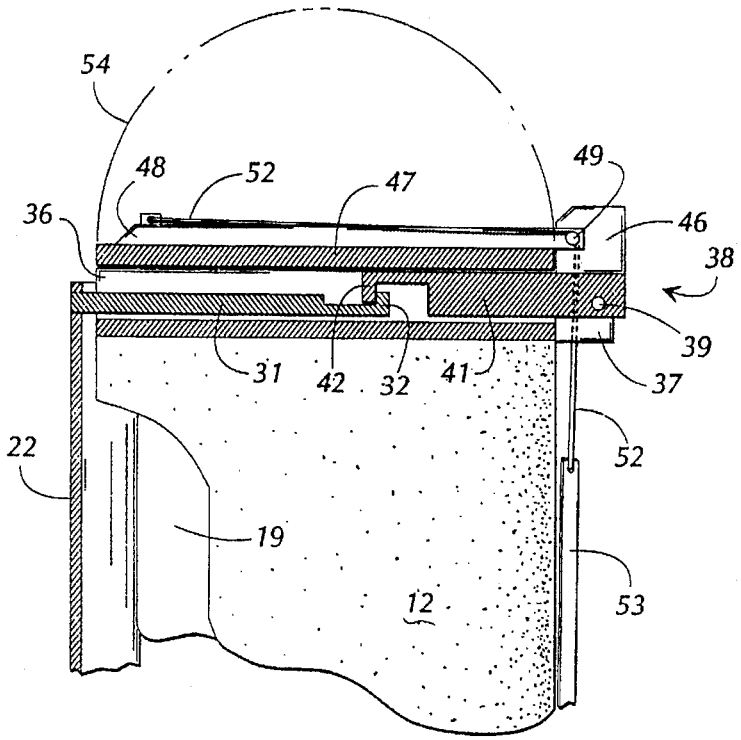
FIG. 3 is a sectional view of the nose end section of the rocket showing the chute release mechanism latched in place for flight and illustrating the relative placement and configuration of the various elements of the invention.

Referring to FIGS. 1 and 3, an elongated latch pin 31 is attached to and extends inwardly from the top portion of the hatch 22 toward the rocket body. The free end of the latch pin 31 is formed with an upwardly extending tang 32 that is used, as detailed below, to secure the latch pin 31 and thus the hatch 22 in a closed position during flight of the rocket.

A velocity dependant chute release mechanism 33 is adhesively fixed to the top of the rocket fuselage 12. The mechanism 33 is designed to release the latch pin 31 and thus open the hatch 22 to deploy the chute when the rocket slows to a predetermined, relatively small velocity. The release mechanism 33 comprises a base plate 34 formed with a diametrically extending groove 36. The groove 36 is sized and positioned to receive the latch pin 31 of the hatch 22 as the hatch is moved to its closed position covering the cavity 19. The position of the latch pin 31 relative to the groove 36 when the hatch is in its closed position is best illustrated in FIG. 3.

A spaced pair of hinge blocks 37 protrude from the base plate 34 on either side of the groove 36 opposite the end of the groove into which the latch pin 31 is received. A generally L-shaped latch keeper 38 is pivotally mounted between the hinge blocks 37 on a hinge pin 39. The latch keeper 38 has a first leg 41 that is sized and located to move into the groove 36 as the latch keeper pivots about hinge pin 39 inwardly toward the rocket. A downwardly extending tang 42 is formed at the end of the first leg 41 and is positioned to capture the upwardly extending tang 32 of the latch pin 31 when the hatch 22 is closed, as best illustrated in FIG. 3. In this way, when the latch keeper is fully pivoted to the closed orientation in which it is illustrated in FIG. 3, it functions to hold the latch pin 31 securely in place thus releasably latching the hatch 22 in its closed position. Naturally, when the latch keeper is hinged back in a clockwise direction as viewed in FIG. 1, the latch pin 31 is released permitting the hatch 22 to spring open under the influence of coil spring 28.

A disc-shaped flap 47 is fixed to a diametrically extending elongated hinge bar 48. One end of the hinge bar 48 extends beyond the periphery of the flap 47 and is disposed and pivotally secured on a hinge pin 49 between the spaced halves 44 and 46 of the latch keeper's second leg 43. With this configuration, the flap 47 is pivotable relative to the latch keeper about hinge pin 49 in the directions indicated by arrow 51. It can thus be seen that the latch keeper 43 is pivotable relative to the base plate 34 about hinge pin 39 and that the flap 47 is pivotable relative to the latch keeper 43 about hinge pin 49. Further, hinge pin 49 is inwardly displaced toward the rocket relative to the hinge pin 39. As discussed below, this offset double-hinged arrangement of the latch keeper and flap functions to insure that the hatch 22 remains securely closed and latched during rocket flight even if the flap 47 should flutter or otherwise move slightly about its hinged attachment.

A small cord or thread 52 is fixed at one end to the free end of the hinge bar 48 and extends therefrom to its other end, which is fixed to the end of a rubber band 53. The rubber band 53, in turn, extends downwardly toward the tail end of the rocket fuselage 12, where it is affixed to the fuselage by means of adhesive or another appropriate fastener. The cord 52 and the rubber band 53 have respective lengths that are chosen to insure that the rubber band and cord are slack when the flap and latch keeper are open as illustrated in FIG. 1, but become tight and tensioned when the latch keeper and flap are closed as illustrated in FIG. 3. Furthermore, the size of and thus tension provided by the rubber band is selected such that when the flap 47 is closed as shown in FIG. 3, the rubber band and cord tend to create a small torque or force on the flap 47 that acts to bias the flap toward its open position.

While a rubber band in conjunction with a cord has been illustrated in the preferred embodiment, it will be understood that the cord is not an essential element of the embodiment. The rubber band itself might be configured to extend the full distance spanned by the band and the cord, thus eliminating the necessity of the cord altogether.

Naturally, while a rubber band or rubber band and cord for biasing the flap has been illustrated, it will be understood by those of skill in the art that various other means, such as a spring, for biasing the flap toward its open position might also be employed with comparable results. For example, a spring might be used in place of the rubber band or a spring might be integrated into the offset double-hinged attachment of the latch keeper and flap to create a comparable biasing force. Therefore, the rubber band and cord of the illustrated embodiment should not be considered a limitation of the invention but only exemplary of one biasing methodology that is known to function adequately. Further, although not functionally required, in actual commercial use, a nose-cone 54 preferably is fixed to and covers the flap 47 to provide a pleasing and realistic aesthetic appearance for the nose section of the rocket 13.

FIG. 3 illustrates in cross-section the nose-cone of the rocket and the chute release mechanism as they appear with the parachute packed in the cavity 19 and the rocket ready for launch. Here, the hatch 22 is seen to be closed to cover the cavity 19 and confine the parachute therein. With the hatch closed, its latch pin 31 extends into the groove 36 of the base plate 34. The flap 47 is seen to be in its closed position with the cord 52 extending tautly from the end of the hinge bar 48 over the hinge pin 49 and thence downwardly to the end of the rubber band 53.

Since the hinge pin 49 is offset and inwardly displaced toward the rocket relative to the hinge pin 39, the downwardly directed tension provided by the rubber and on the hinge pin 49 creates torque on the latch keeper 38 that tends to pivot the latch keeper in a counter-clockwise direction about is hinge pin 39 and hold the latch keeper securely in its closed position. In addition, when the latch keeper 38 and the flap 47 are in their closed positions as shown in FIG. 3, the moment arm about hinge pin 49 is very small. In fact, the moment arm under these conditions is roughly equal to the distance between the center of hinge pin 49 and slightly beyond the radius of the hinge pin itself. Thus, the torque created by the rubber band about hinge pin 49 tending to open the flap is comparably small. This means that it is easy for the force of the wind to hold the flap down against the small torque when the rocket moves rapidly.

However, as the rocket slows to near zero velocity, the small torque about hinge pin 49 is sufficient to begin to open the flap against the force of the wind. As the flap moves, the rubber band and cord move outwardly away from hinge pins 49 and 39, as best illustrated in FIG. 1. Thus, the moment arm about hinge pin 49 and about hinge pin 39 increases as the cord moves away from the hinge pins. Therefore, as the flap opens, the torque and force tending to open it increases with the increasing length of the moment arm thus pulling the flap with increasingly greater force. When the flap ultimately engages the second leg 46 of the latch keeper, the torque is applied to the latch keeper itself tending to rotate it about hinge pin 39 to its open position. This torque, in conjunction with the force of any wind on the bottom of the flap, is more than sufficient to overcome any friction between the tangs 42 and 32 so that the latch pin 31 is released quickly and reliably. Accordingly, with the double hinged arrangement of the flap and latch keeper, once the flap begins to open, it flips open quickly to release the chute.

In the closed position of the latch keeper, the downwardly extending tang 42 captures the upwardly extending tang 32 of the latch pin 31 to latch and hold the hatch 22 securely in its closed position covering the cavity 19 as shown. It can thus be seen that even if the flap 47 flutters or even pivots a significant amount about hinge pin 49, the downward force of the rubber band 53 and cord 52 on the offset hinge pin 49 still continues to apply torque to the latch keeper 38 and thus maintains the latch keeper securely in its closed latched position.

Figure 4:
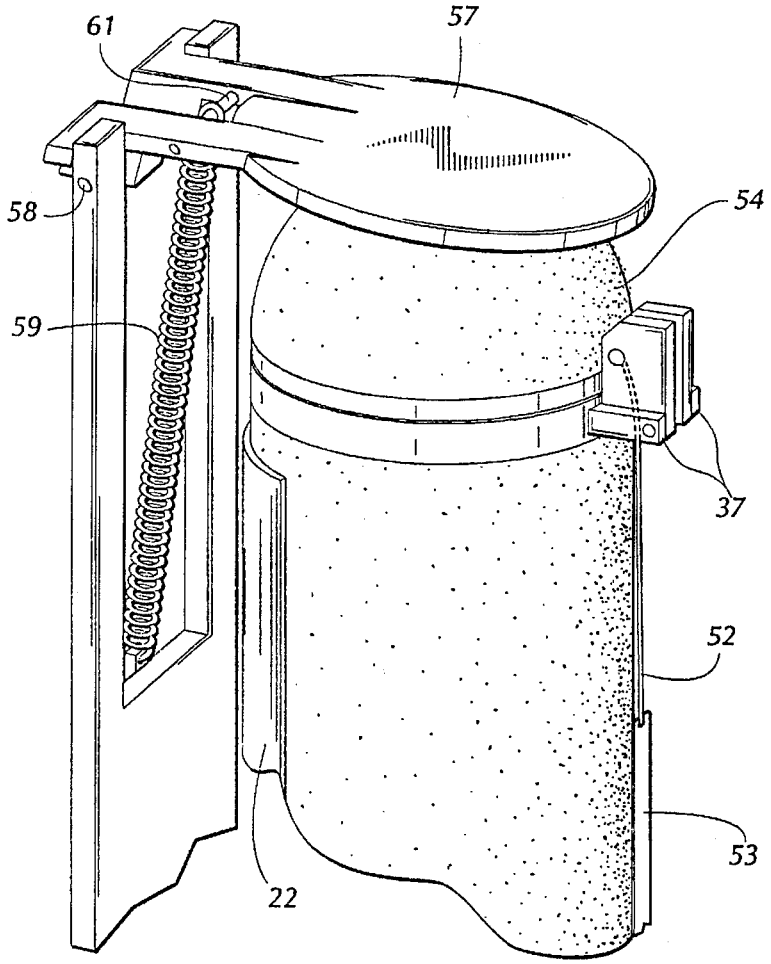
FIG. 4 is a perspective view showing that the nose-cone section of the toy rocket of this invention as it appears when closed, latched and mounted on a launcher for flight.

FIG. 4. illustrates the nose section of the rocket as it appears on the launcher prior to launch. The parachute has been folded and placed into the cavity, the hatch 22 closed over the cavity, and the latch keeper 38 and nose-cone 54 closed to latch and hold the hatch 22 in place. The launcher is provided with a paddle 57 that is hingedly mounted to the launcher structure by means of a hinge pin 58. A coil spring 59 is secured at one end to the launcher and is secured at is other end to a spring pin 61, which is inwardly displaced toward the rocket from the hinge pin 58. Thus, the spring 59 tends to hold the paddle 57 securely down against the top of the rocket's nose-cone 54 to prevent the nose-cone from being sprung to its open position prior to launch by the tension of the rubber band 53. Therefore, the paddle 57 and spring 59 function to hold the chute release mechanism closed while the rocket is on the launching pad.

When the rocket is launched, the paddle 57 is forced by the moving rocket to pivot rearwardly until its spring pin 61 rotates around and becomes rearwardly displaced relative to the hinge pin 58. At this point, the force of the spring 59 on the hinge pin 51 flips the paddle 57 backwardly and holds it open so that it does not interfere with movement of the rocket body as the rocket leaves the launcher.

In use of this invention, the rocket is launched into the air for flight by means of a compressed air or other launching mechanism. Immediately upon launch of the rocket, the paddle 57, which holds the nose-cone and latch down on the launcher, is pushed aside. The initial acceleration of launch acting on the rocket tends to hold the flap 47 and thus nose-cone 54 downwardly in the closed position illustrated in FIG. 4.

Once the rocket leaves the launcher, it moves through the air with substantial velocity. This results in the movement of wind past the body of the rocket as indicated by arrows 56 in FIG. 2. The wind impinging upon and compressing against the nose-cone 54 of the rocket 13 causes a force that acts downwardly against the nose-cone. This force tends to take over where the acceleration of launch left off to hold the flap 47 downwardly in its closed latching position as the rocket moves through the air. As the rocket slows on its upward trajectory, the force created by the wind gradually lessens until, near the apogee of the trajectory, the velocity of and force created by the wind becomes very small compared to its initial value.

As the force created by the moving wind on the nose-cone lessens, it ultimately reaches a magnitude that is smaller than the magnitude of the counteracting bias force created on the flap by the cord 52 and rubber band 53. At this point, the biasing force overcomes the force of the wind and causes the nose-cone and flap to pivot rearwardly about hinge pin 49 to their open position. As the flap pivots under the influence of the rubber band and cord, it ultimately engages the second leg 43 of the latch keeper 38. Further movement of the flap, then, draws the latch keeper back causing it to pivot rearwardly about latch pin 39 out of its closed position and toward its open position. The downwardly extending tang 42 of the latch keeper 38 is thus withdrawn from the groove 36. This releases the upwardly extending tang 32 on the latch pin 31 and thus frees the latch pin.

With its latch pin freed, the hatch 22 is sprung open under the influence of spring 28. As the hatch opens, it pulls the chute cords 29 and the parachute 21 out of the cavity 19 thus deploying the chute rapidly and reliably from the rocket. Once deployed, the chute eases the rocket back to earth in the usual way.

In practice, it is desirable that the parachute be deployed just prior to the apogee of the rocket's trajectory, regardless of the initial force with which the rocket is launched or the altitude to which it climbs. This insures that the rocket complete its entire flight before deployment of the chute and that the rocket is not already plummeting to earth when the chute is deployed. To facilitate this desired goal, the size and tension of the rubber band 53 is selected so that the biasing force imparted to the flap 47 by the rubber band and cord is of a predetermined small magnitude corresponding to the force of the wind on the nose-cone when the rocket is traveling at a relatively slow predetermined velocity just prior to apogee.

The biasing force on the flap provided by the rubber band is thus less than the force of the wind on the flap when the rocket moves at speeds greater than the predetermined velocity and is greater than the force of the wind when the rocket slows to a speed less that the predetermined velocity. It will therefore be seen that when the rocket slows to a speed less than the predetermined velocity, the biasing force overcomes the force of the wind causing the flap and latch keeper to spring back to release the hatch and deploy the chute. Since the release of the chute is dependent upon the velocity of the rocket, the chute is consistently deployed at roughly the same time just before the apogee of the rocket's trajectory. Further, the deployment time is independent of the force with which the rocket is launched or the altitude to which it climbs. In addition, deployment of the chute does not depend upon an explosive charge or other event that is tied to the burn-out of an engine but is a function only of the velocity of the rocket. Thus, previous problems associated with deploying chutes from powered model rockets are avoided altogether.

Figure 5:
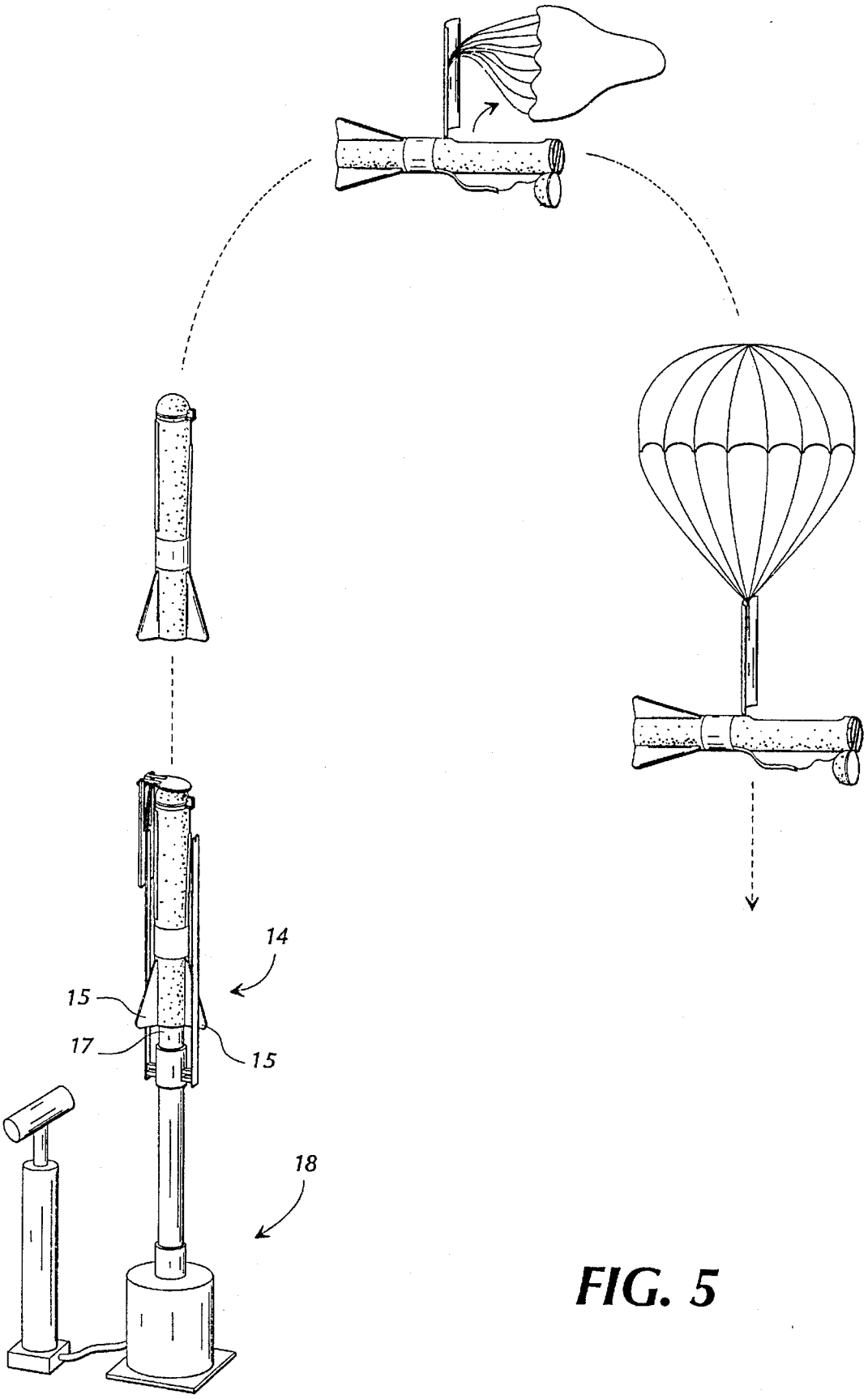
FIG. 5 is a sequence illustration shown stages of rocket flight from its pone position on the launcher to deployment of the chute at the apogee of the rocket's trajectory.

The just described cycle is illustrated in the sequence of FIG. 5. The first snapshot of the sequence shows the rocket mounted in a launch prone position on its launcher which, in this embodiment, comprises a compressed air launching mechanism. Once launched, the rocket travels upwardly at a relatively high speed and the wind generated by the rocket's motion holds the nose-cone down thus keeping the chute hatch latched and closed. However, as the rocket slows near its apogee, the force of the wind is overcome by the biasing force of the rubber band 53, and the nose-cone 54, flap 47, and latch keeper 38 are hinged backward. This releases the latch pin and opens the hatch 22. As the hatch 22 opens, its pulls the parachute cords and the parachute out of the cavity 19, which results in the deployment of the parachute. Once deployed, the parachute eases the rocket body back to the ground where it can be recovered.

Figure 6:
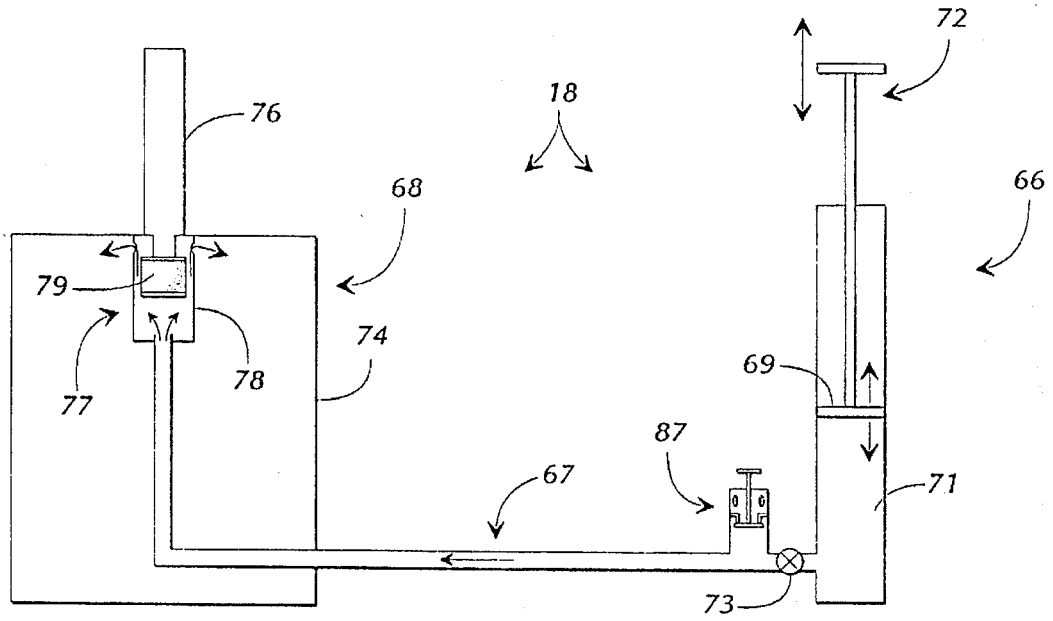
FIGS. 6 and 7 illustrate a preferred configuration and function of the pressurization and release valve mechanism for launching the rocket of this invention into the air.
Figure 7:
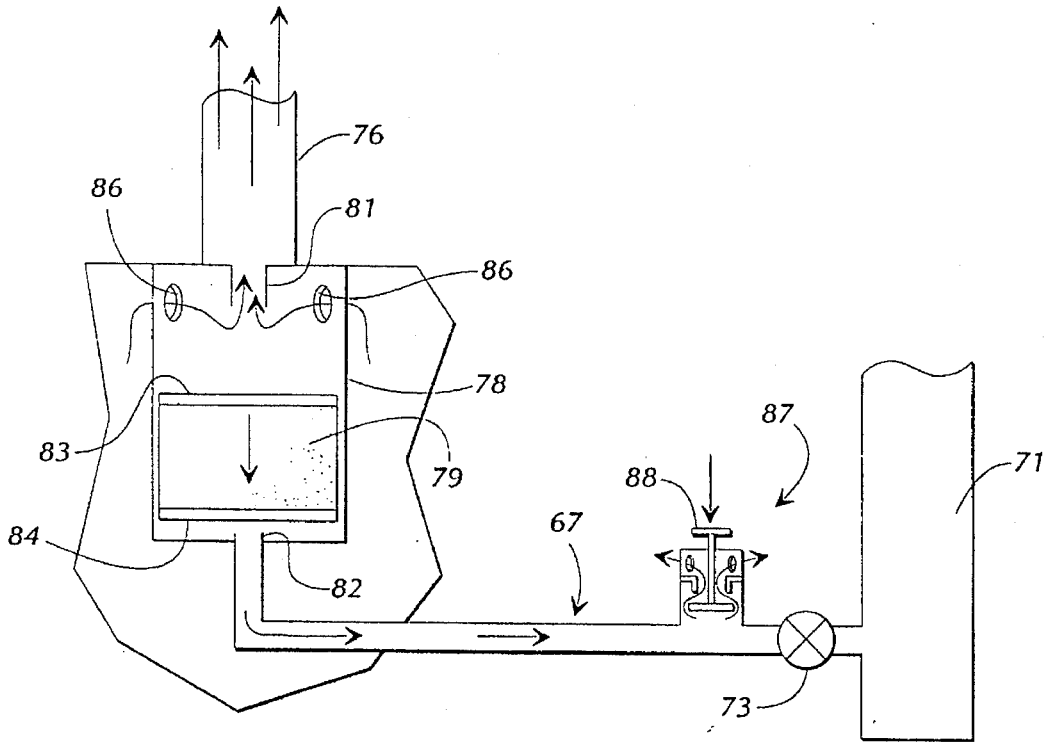

FIGS. 6 and 7 illustrate the mechanical functioning of the launcher 18 (FIG. 5). Specifically, FIG. 6 and 7 show in detail the pressurization and release mechanism employed to pressurize the launcher and selectively release the pressure through the launch tube to catapult the rocket into the air.

Launcher 18 is seen to comprise a manual pump 66 coupled through a hose or tube 67 to the launcher base assembly 68. The pump 66 is of conventional construction and comprises a plunger 69 that can be reciprocated up and down within a pump cylinder 71 by means of a handle and push rod assembly 72. As the plunger 69 is manually reciprocated up and down within the cylinder 71, air is forced through the hose 67 to the launcher base assembly 68. A one-way check valve 73 prevents the movement of air through the hose 67 back to the pump 69.

The launcher base assembly 68 comprises a pressure chamber 74 from which a cylindrical hollow launch tube 76 upwardly extends. As seen in FIG. 5, in use, the toy rocket is slid over the launch tube 76 whereupon the release of pressure through the tube catapults the rocket into the air for flight.

A release valve assembly 77 is mounted within the pressure chamber 74 just beneath and communicating with the launch tube 76. As detailed below, the release valve assembly 77 functions to allow the pressure chamber 74 to be pressurized prior to launch of the rocket and also functions to release the pressure within the pressure chamber through the launch tube 76 when it is desired to launch the rocket. The release valve assembly 77 comprises a cylindrical manifold 78 that carries an internal cylindrical plunger 79. The plunger 79 fits relatively loosely within the manifold 78 such that it is free to slide up and down within the manifold.

The manifold 78 communicates at its upper end with the launch tube 76 and at its lower end with the hose 67, through which air is pumped by means of the pump 66. Seating lips 81 and 82 are formed about the ports that communicate with the launch tube 76 and hose 67 respectively. Seating gaskets 83 and 84 are provided on the upper and lower surfaces respectively of the plunger 79. With this configuration, it will be understood that when the plunger is slid upwardly to engage the lip 81, the gasket 83 seats and seals about the lip 81 to close off communication with the launch tube 76. Similarly, when the plunger is slid down within the manifold 78, the gasket 84 engages and seals about the lip 82 to close off communication with the hose 67. Finally, the manifold 78 is formed with a set of openings 86 disposed about its upper periphery. The openings 86 communicate with the interior of the pressure chamber 74 for purposes set forth in greater detail below.

A manually operable trigger valve assembly 87 is coupled in line with the hose 67. The trigger valve assembly 87 comprises a manually operable plunger 88 that can be depressed to release air pressure from within the hose 67 as best illustrated in FIG. 7.

The just described launcher functions as follows to catapult a rocket into the air for flight. First, the rocket is slid onto the launch tube 76 in its launch-prone position as shown in FIG. 5. The pump 66 is then operated causing air to be forced under pressure through the hose 67 and into the bottom of the manifold 78. The initial in-rush of air into the manifold drives the plunger 79 upwardly until it seats and seals against the lip 81 closing off communication with the launch tube 76. Air flowing through hose 67 then passes around the sides of the plunger 79 and exits the manifold through the openings 86. The exiting air creates pressure within the pressure chamber 74 and also within the manifold 78. This increased pressure, in turn, continues to hold the plunger 79 up against the lip 81. Continued operation of the pump 66, then, further pressurizes the chamber 74 and the pump is operated until the desired pressure level is achieved.

Figure 10:
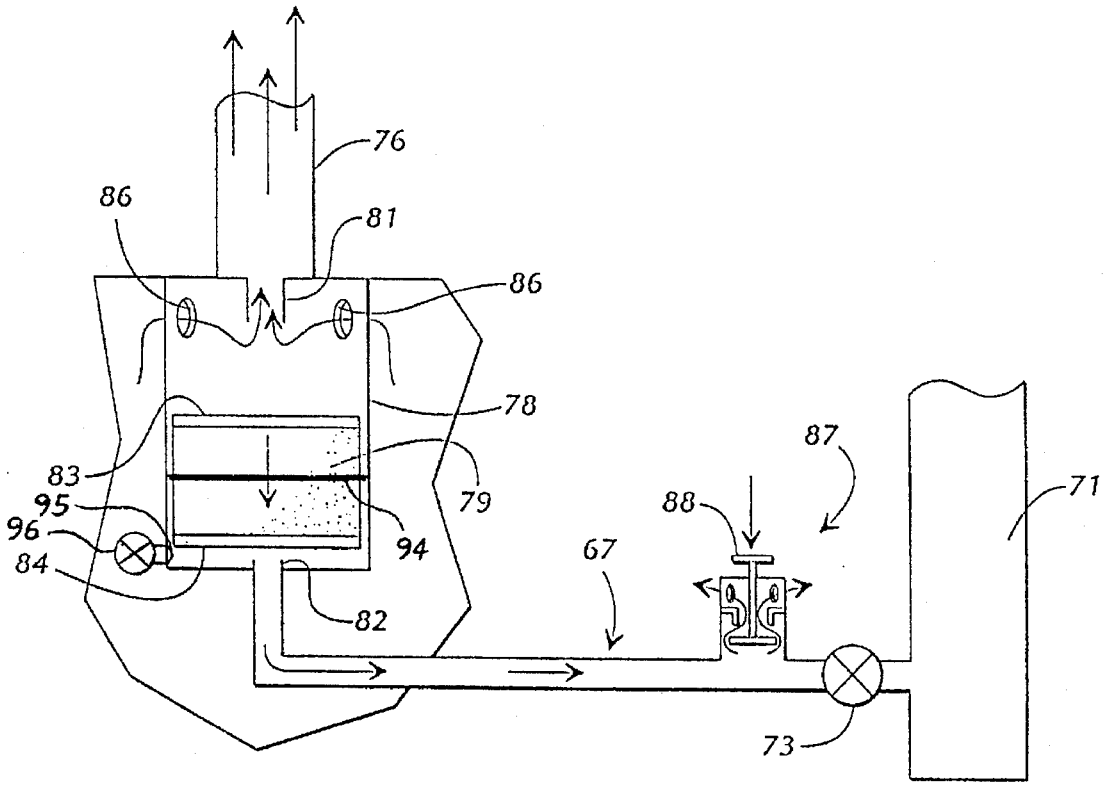
FIG. 10 is a partial cross-sectional view of another alternative embodiment of the rocket launcher of FIGS. 6 and 7.

As shown in FIG. 10, as an alternative to a loose fitting plunger with pressurized air passing about the sides of the plunger to pressurize the chamber through openings 86, the plunger could fit snugly and sealingly within the manifold to inhibit air passage around its sides, or have an O-ring type seal 94 to prevent the passage of air about the plunger. In such an embodiment, a second opening 95 is formed in the manifold adjacent the second end thereof with the second opening communicating with the interior of the chamber through a one-way valve assembly 96. With such an embodiment, compressed air supplied through the pressure hose 67 would pass through the second opening or orifice 95 to pressurize the chamber rather than passing around the plunger and through the opening 86. This prevents the possibility that the air passing around the plunger pass so rapidly as to not cause the plunger to move upward. Also, this prevents any fluttering of the plunger as the air passes thereabout which may cause it not to seal against lip 81.

With the pressure chamber 74 pressurized, the toy rocket can be launched into the air for flight by depressing the plunger 88 of the trigger valve assembly 87. Specifically, as best seen in FIG. 7, when the plunger 88 is depressed, pressure within the hose 67 is released and allowed to escape through openings in the trigger valve assembly. This reduces the pressure within the hose 67 and, in turn, rapidly reduces the pressure in the lower portion of the manifold 78 beneath the plunger 79. As a consequence, pressure from within the pressure chamber 74 presses downwardly on the top of the plunger 79 causing the plunger 79 to slide down the manifold to engage and seat against the lip 82 as seen in FIG. 7. When the plunger 79 moves downwardly in this fashion, all of the pressurized air within the pressure chamber 74 is free to move through the openings 86 and into the launch tube 76. In practice, the openings 86 are sized to allow an extremely rapid release of pressured air through the launch tube in a sudden burst. The burst of pressurized air through the launch tube 76, in turn, catapults the toy rocket into the air for flight as illustrated in FIG. 5.

The just described pressurization and release mechanism has proven to be reliable and efficient both in construction and in operation. Furthermore, with the illustrated assembly, the release trigger for launching the rocket can be located on or adjacent to the pressurization pump, which, in turn, can be located any desired distance from the actual launcher base assembly 68 by means of an appropriate length of hose 67. Thus, the operator can be located at some distance from the launcher and can both pressurize the launcher and launch the rocket from the same location. Also, only one connecting hose 67 is required between the pump and the launcher rather than a pressurization hose and a trigger hose as has sometimes been required in the prior art.

Figure 8:
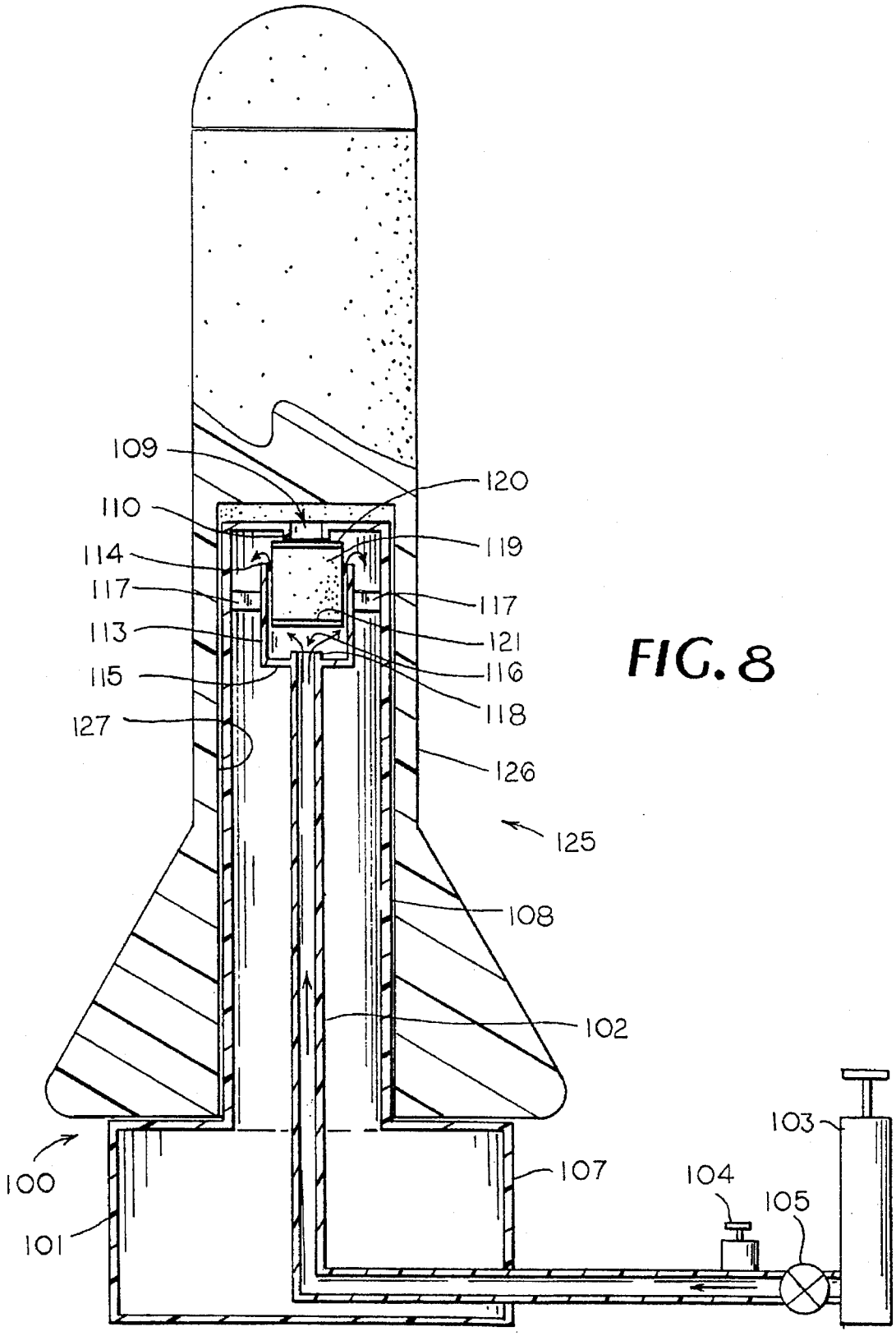
FIG. 8 is a partial cross-sectional view of an alternative embodiment of the rocket launcher and rocket shown in FIG. 6, with the plunger shown in a sealing position.
Figure 9:
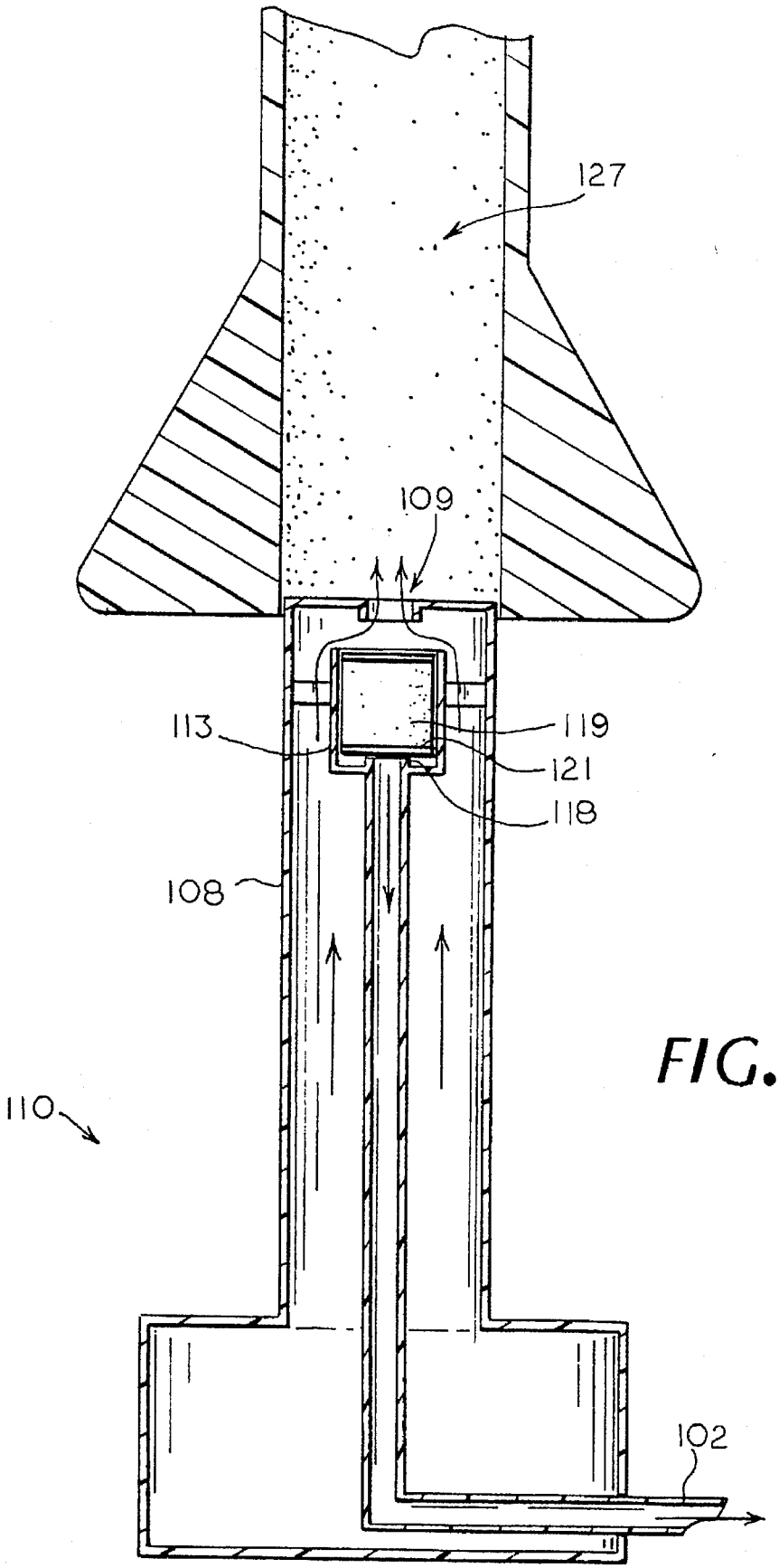
FIG. 9 is a partial cross-sectional view of a portion of the launcher and rocket of FIG. 8, with the plunger shown in a released position and the rocket shown being propelled from the launcher.

Referring next to FIGS. 8 and 9, a rocket launcher 100 in another preferred form is shown as an alternative to that shown in FIGS. 6 and 7. The launcher 100 has a pressure chamber 101 adapted to receive and store a supply of air at a selected elevated pressure level. The launcher also has a pressure hose 102 coupled to a pump 103, to a trigger valve assembly 104 and to a check valve 105. The pump 103, trigger valve assembly 104 and check valve 105 are all similar to that previously describe. The pressure chamber 101 includes a base 107 and an elongated launch tube 108 integrally extending from base 107. The launch tube 108 has a top end or tip having an opening 109 therethrough and an annular seating lip or flange 110 about the opening 109.

The launcher 100 also has a cylindrical manifold 113 mounted within the launch tube 108 below opening 109. The manifold 113 has an open top 114 and a bottom wall 115 having an opening 116 therein coupled in fluid communication with pressure hose 102. The bottom wall 115 has an annular seating lip or flange 118 about opening 116. A radial array of supports 117 maintain the position of the manifold within the launch tube. A cylindrical plunger 119 is slidably mounted within manifold 113. The plunger 119 has a top gasket 120 and a bottom gasket 121.

The launcher is designed to be used with a rocket 125 having a fuselage 126 with a longitudinal bore 127 therein extending from the bottom or tail of the fuselage. The launch tube 108 of the launcher 100 is sized and shaped to fit snugly within rocket bore 127.

In use, the rocket 125 is mounted upon the launcher 100 with the launcher tube 108 positioned within the rocket bore 127. The pump 103 is then actuated to pressurize air within pressure chamber 101. As shown in FIG. 8, the pressurization of the pressure chamber causes the plunger 119 to move upward to its sealing position with its top gasket 120 abutting seating lip 100, thus sealing the interior of the pressure chamber from ambience. The actuation of the pump is continued to increase the air pressure within the chamber to a desired air pressure in the same manner previously described.

The actuation of trigger 104 causes the release of air within pressure hose 102 and within the manifold below plunger 119. This release of pressure causes the plunger 119 to move downward to its released position shown in FIG. 9. The movement of the plunger causes the bottom gasket to abut seating lip 118, thus sealing off pressure hose 102. This also allows the pressurized air within the pressure chamber to flow about manifold 113, to flow between the manifold and the sealing lip 110, and to be expelled through opening 109. The just described actions of the plunger and trigger are all similar to those previously described. The expelled pressurized air rapidly enters the rocket tail bore 127 thus causing the rocket to be propelled from the launcher.

It should be understood that the just describe embodiment has distinct advantages. For example, the manifold 113 is spaced from the launch tube 108 and seating lip 110 so that the pressurized air flowing past the manifold enters the rocket tail bore substantially unrestricted, as opposed to the embodiment of FIGS. 6 and 7 wherein the air must pass through openings 86 in the manifold 78. This unrestricted airflow allows for a quicker release of the pressurized air. Other distinct advantages are related to the positioning of the plunger 119 and manifold closely adjacent the launch tube top opening 109. This positioning directs the pressurized air expelled from the pressure chamber 101 directly into the rocket tail bore 127, as shown in FIG. 9, rather than into both the launch tube 76 and the rocket tail bore of the previous embodiment. As a result, the volume of airspace pressurized by the compressed air released from the pressure chamber is greatly decreased. The decrease in the pressurized volume of airspace results in a greater and faster pressurization of the rocket tail bore 127 and hence a more efficient use of the pressurized air. This increase of efficiency allows the rocket to be propelled faster and higher. Additionally, this allows the launcher to be pressurized at a lower pressure so as to decrease the possibility of rupture and decrease the work energy required to pressurize the launcher.

It thus is seen that a rocket launcher in now provided which quickly and efficiently pressurizes a rocket for propulsion. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A compressed air actuated launcher for propelling a projectile of the type having a tail bore, comprising:

a base;

a launch tube mounted to said base and adapted to receive and store a supply of compressed air and being sized and shaped to be inserted into projectile tail bore and an opening adjacent one end thereof distal said base;

valve means mounted adjacent said launch tube opening for controlling the flow of air therethrough;

pump means for pressurizing said launch tube; and trigger means for triggering said valve means to release compressed air through said opening and into the projectile tail bore.

2. The launcher of claim 1 wherein said launch tube end is an insertion end of said launch tube for initial insertion into the projectile tail bore.

3. The launcher of claim 1 wherein said valve means comprises a manifold mounted adjacent said opening of said launch tube, and a plunger slidably mounted within said manifold for reciprocal movement between a first position sealing said opening and a second position unsealing said opening.

4. The launcher of claim 3 wherein said trigger means includes a conduit that extends from said pump means to said manifold through said launch tube.

5. A launcher for launching a rocket of the type having a tail bore, said launcher comprising:

a launch tube configured to be inserted into the rocket tail bore and adapted to receive and store compressed air, said launch tube having an opening adjacent an end thereof, and valve means for controlling the flow of air through said opening;

means for pressurizing said launch tube; and trigger means for operating said launch tube valve.

6. The launcher of claim 5 wherein said trigger means includes a conduit that extends from said pressurizing means through said launch tube to said valve means.

7. The launcher of claim 5 wherein said valve means comprises a manifold mounted adjacent said opening of said launch tube, and a plunger slidably mounted within said manifold for reciprocal movement between a first position sealing said opening and a second position unsealing said opening.

8. A compressed air actuated launcher for propelling a projectile of the type having a tail bore, comprising:

a pressure chamber for holding pressurized air therein;

a launch tube in fluid communication with said pressure chamber configured to be inserted into the projectile tail bore, said launch tube having an opening adjacent said pressure chamber;

valve means mounted adjacent said launch tube opening for controlling the flow of air from said pressure chamber to said launch tube, said valve means including a manifold having a first end adjacent said launch tube opening and a second end distal said launch tube opening, said manifold also having an orifice and a check valve coupled with said orifice to allow air to pass from within said manifold to said pressure chamber and to prevent air from passing from said pressure chamber into said manifold, and a plunger slidably mounted within said manifold for reciprocal movement between a first position sealing said opening so that said pressure chamber is not in fluid communication with said launch tube and a second position unsealing said opening so that said pressure chamber is in fluid communication with said launch tube;

pump means for pressurizing said pressure chamber; and trigger means for triggering said valve means to release compressed air through said opening and into the projectile tail bore, whereby actuation of the pump means forces air into the control valve manifold which moves the plunger therein to its first position preventing air within the pressure chamber from flowing into the launch tube through the launch tube opening, and continued actuation of the pump forces air from the manifold and into the pressure chamber through the manifold orifice and check valve, and actuation of the trigger means causes the plunger to move to its second position whereby the launch tube opening is unsealed so that compressed air within the pressure chamber is in fluid communication with the launch tube through the launch tube opening for launching of the projectile.

9. The launcher of claim 8 wherein said manifold orifice is located adjacent said manifold second end.

10. The launcher of claim 8 wherein said trigger means includes a conduit that extends from said pump means to said valve means.

11. The launcher of claim 10 wherein said manifold orifice is located adjacent said conduit.

12. The launcher of claim 8 further comprising sealing means for sealing said plunger to said manifold.

* * * * *